US007575341B2

(12) United States Patent
Liao

(10) Patent No.: US 7,575,341 B2
(45) Date of Patent: Aug. 18, 2009

(54) LAMP STRUCTURE

(76) Inventor: Yung-Chiang Liao, 2F-6,NO.128,Sec.2,Dunhua S. Rd., Da-an District, Taipei City,106 (TW)

( * ) Notice: Subject to any disclaimer, the term of this patent is extended or adjusted under 35 U.S.C. 154(b) by 92 days.

(21) Appl. No.: 11/735,666

(22) Filed: Apr. 16, 2007

(65) Prior Publication Data

US 2008/0253124 A1 Oct. 16, 2008

(51) Int. Cl.
*F21V 33/00* (2006.01)
*F21V 21/00* (2006.01)

(52) U.S. Cl. ..... 362/240; 362/234; 362/294; 362/640; 362/647; 362/249; 313/500; 257/88; 257/99

(58) Field of Classification Search ..... 362/294, 362/240, 640, 647, 655, 657, 658, 800, 249, 362/227, 234; 313/500; 257/88, 99, 666, 257/675

See application file for complete search history.

(56) References Cited

U.S. PATENT DOCUMENTS

| | | | | | |
|---|---|---|---|---|---|
| 4,447,859 | A * | 5/1984 | Raczynski | ..... | 362/13 |
| 4,918,576 | A * | 4/1990 | Farrall et al. | ..... | 362/11 |
| 5,660,461 | A * | 8/1997 | Ignatius et al. | ..... | 362/241 |
| 6,170,963 | B1 * | 1/2001 | Arnold | ..... | 362/249 |
| 6,220,725 | B1 * | 4/2001 | Arnold | ..... | 362/241 |
| 6,851,837 | B2 * | 2/2005 | Tessnow et al. | ..... | 362/362 |
| 2005/0201097 | A1 * | 9/2005 | Kiraly et al. | ..... | 362/294 |
| 2007/0247851 | A1 * | 10/2007 | Villard | ..... | 362/294 |

* cited by examiner

*Primary Examiner*—Jacob Y Choi

(57) ABSTRACT

A lamp structure includes a plurality of carrier units and a plurality of hollow heat dissipating units put together in an alternating manner so that each carrier unit abuts on at least a hollow heat dissipating unit. Light emitting elements are fitted on the top surface or bottom surface of each carrier unit. The heat generated by light emitting elements is swiftly passed from each carrier unit to the neighboring hollow heat dissipating units and then is quickly dissipated into the ambient air through the hollow portions. Therefore, the goal of fast heat dissipation may be reached.

4 Claims, 5 Drawing Sheets

LAMP STRUCTURE

BACKGROUND OF THE INVENTION

1. Field of the Invention

The invention generally relates to an improved lamp structure. More particularly, the invention relates to an improved lamp structure in which each carrier unit abuts on at least a hollow heat dissipating unit so that heat may be dissipated swiftly.

2. Description of the Prior Art

Hanging lamps, desk lamps and wall lamps have been widely used in our homes for illumination or to create a present atmosphere. However, the lamps of the prior art have the following disadvantages:

1. Most of the lamps of the prior art use incandescent bulbs, mercury lights, sodium lights, etc.; therefore, they have a relatively lower efficiency in terms of the energy conversion from electricity to light and consume relatively more power.

2. The lamps of the prior art do not have any heat dissipating component so that the heat generated by a bulb or a light can not be dissipated quickly and hence such bulb or light has a shorter service life.

Therefore, we can see that the lamps of the prior art have many disadvantages and need to be improved.

To eliminate the disadvantages of the prior art, the inventor has put in a lot of effort in the subject and has successfully come up with the improved lamp structure of the present invention.

SUMMARY OF THE INVENTION

The present invention is to provide an improved lamp structure in which the heat generated by the light emitting elements may be swiftly dissipated so that the light emitting elements may have a longer service life.

The present invention is to provide an improved lamp structure that has a unique structure and is easy to assemble and use.

The improved lamp structure of the present invention comprises a plurality of heat dissipating carrier units and a plurality of hollow heat dissipating units. The carrier units and the hollow heat dissipating units are put together in an alternating manner to form the improved lamp structure of the present invention so that each carrier unit abuts on at least a hollow heat dissipating unit. Light emitting elements are fitted on the top surface or bottom surface of each carrier unit. The heat generated by light emitting elements is swiftly passed from each carrier unit to the neighboring hollow heat dissipating units and then is quickly dissipated into the ambient air through the hollow portions. Therefore, the goal of fast heat dissipation may be reached.

These features and advantages of the present invention will be fully understood and appreciated from the following detailed description of the accompanying Drawings.

DETAILED DESCRIPTION OF THE PREFERRED EMBODIMENT

Figure 1:
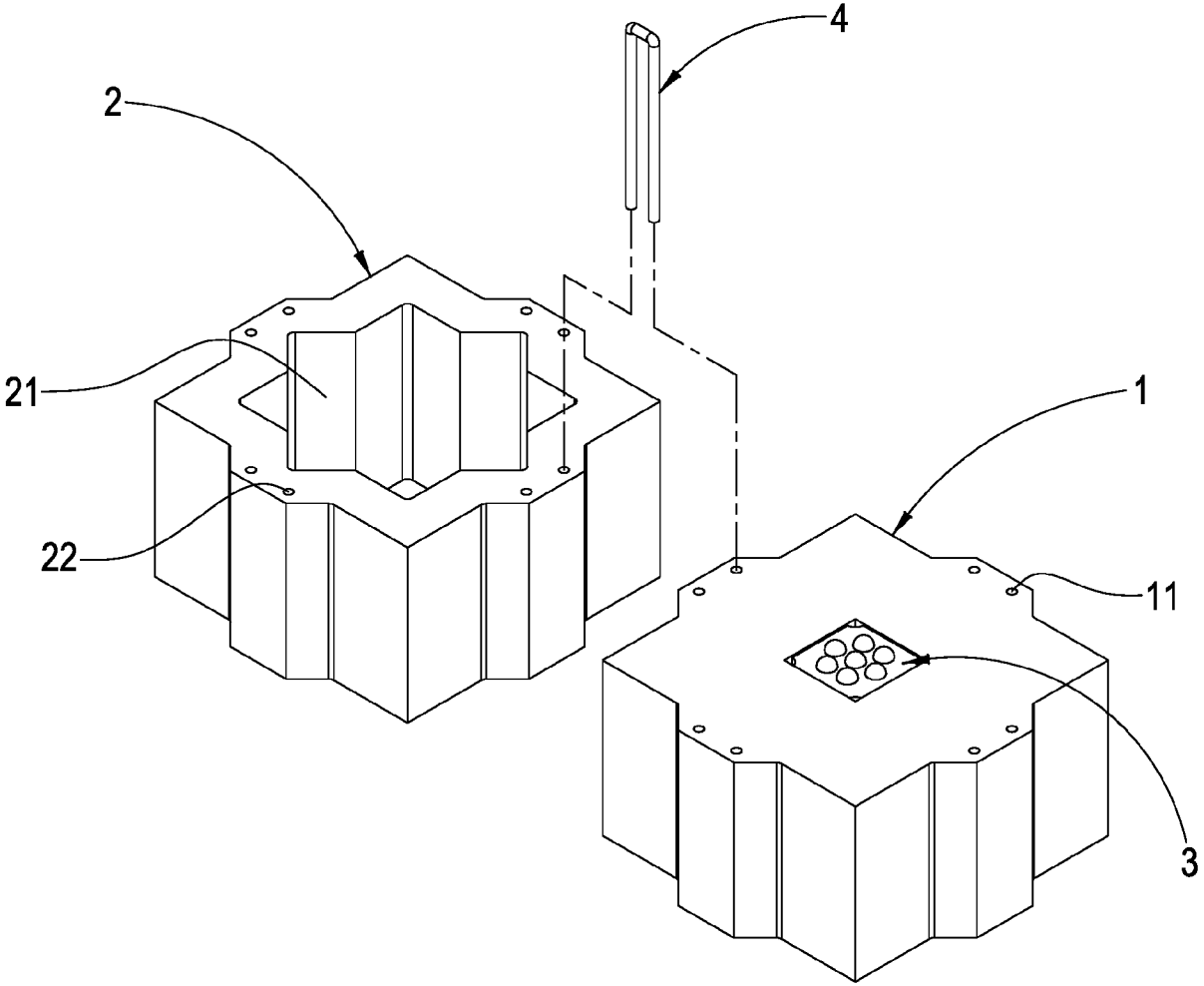
FIG. 1 is a perspective view of a carrier unit and a hollow heat dissipating unit according to the present invention.
Figure 2:
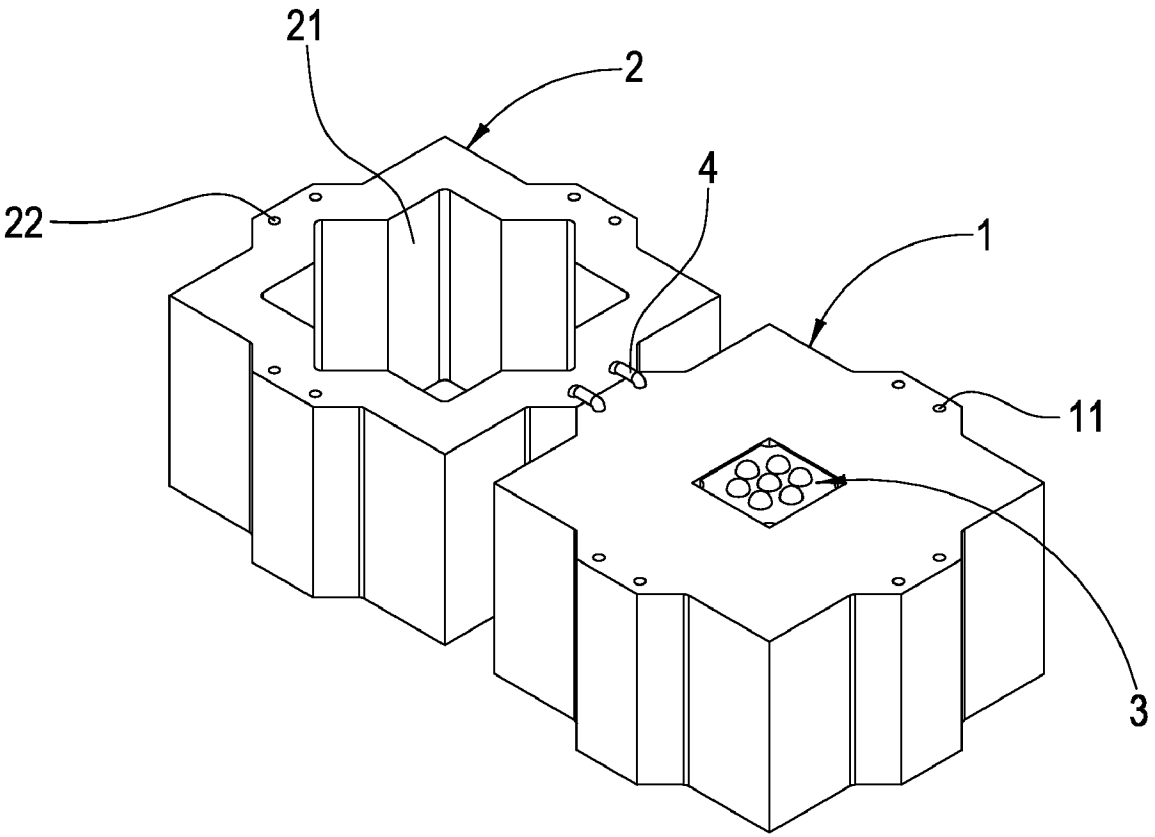
FIG. 2 is a perspective view showing how the carrier unit and the hollow heat dissipating unit are connected together.

Please see FIGS. 1 and 2. The improved lamp structure of the present invention comprises a plurality of heat dissipating carrier units 1, a plurality of hollow heat dissipating units 2 and a plurality of connective pieces 4.

Each carrier unit 1 has the shape of a block and has a flat top surface and a flat bottom surface so as to hold light emitting elements 3. Two holes 11 are provided on each of the four sides of each carrier unit 1.

Each hollow heat dissipating unit 2 also has the shape of a block and also has a flat top surface and a flat bottom surface. A hollow portion 21 is centrally provided in each heat dissipating unit 2. Two holes 22 are provided on each of the four sides of each heat dissipating unit 2. Preferably, the height of each heat dissipating unit 2 is equal to that of each carrier unit 1.

Each connective piece 4 has the shape of "Π" and may be made of two rivets.

Figure 3:
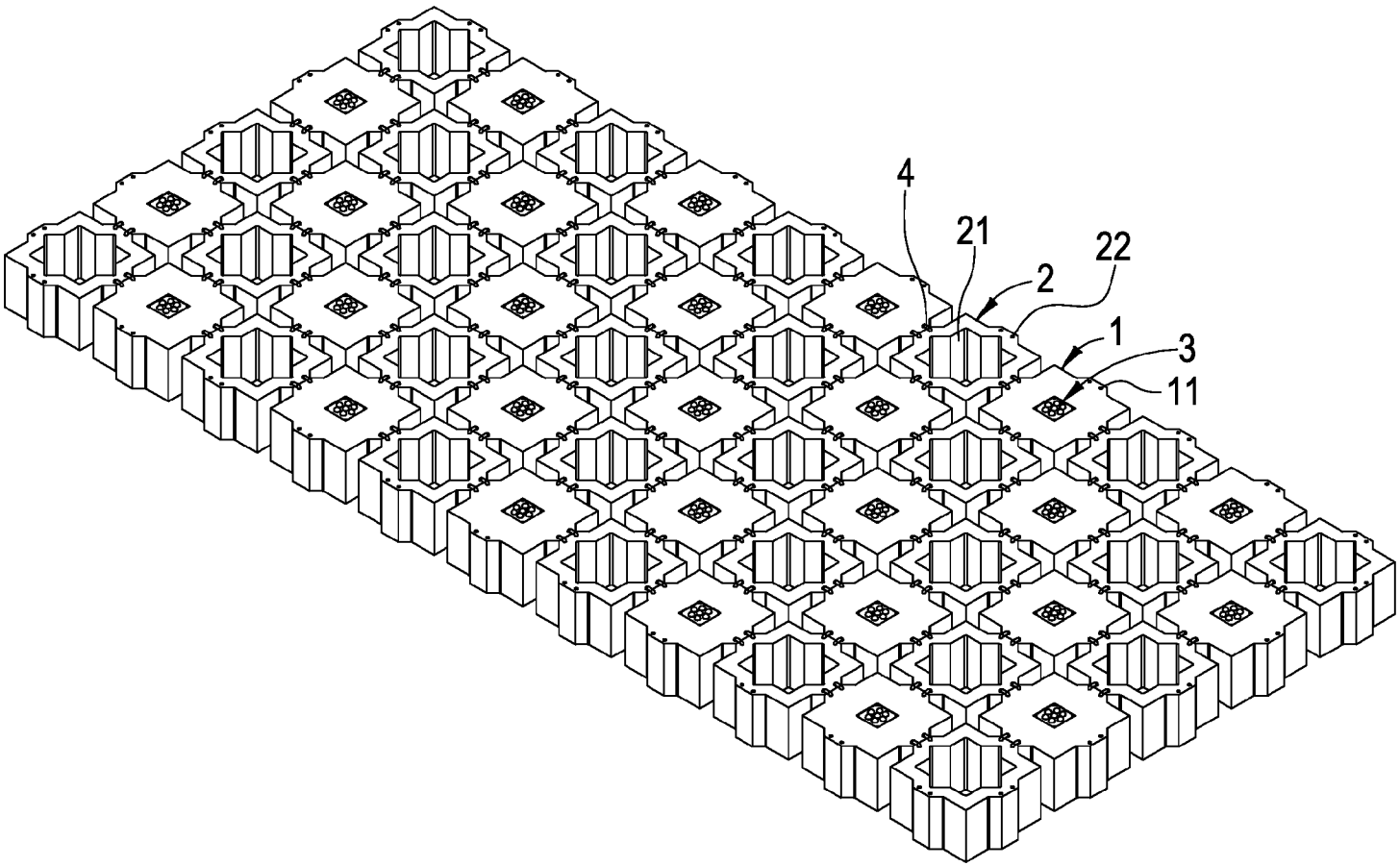
FIG. 3 is a perspective view showing a plurality of carrier units and a plurality of hollow heat dissipating units are put together to form the improved lamp structure of the present invention.

In assembly, the carrier units 1 and the hollow heat dissipating units 2 are connected together so that each carrier unit 1 abuts on at least a hollow heat dissipating unit 2. Preferably, the carrier units 1 and the hollow heat dissipating units 2 are put together in an alternating manner as illustrated in FIG. 3. Also, each of the connective pieces 4 is inserted into the holes 11 and 22 so as to fixedly hold the carrier units 1 and the hollow heat dissipating units 2 together.

Alternatively, the carrier units 1 and the hollow heat dissipating units 2 may be connected together through snap-fitting or other means.

Figure 5:
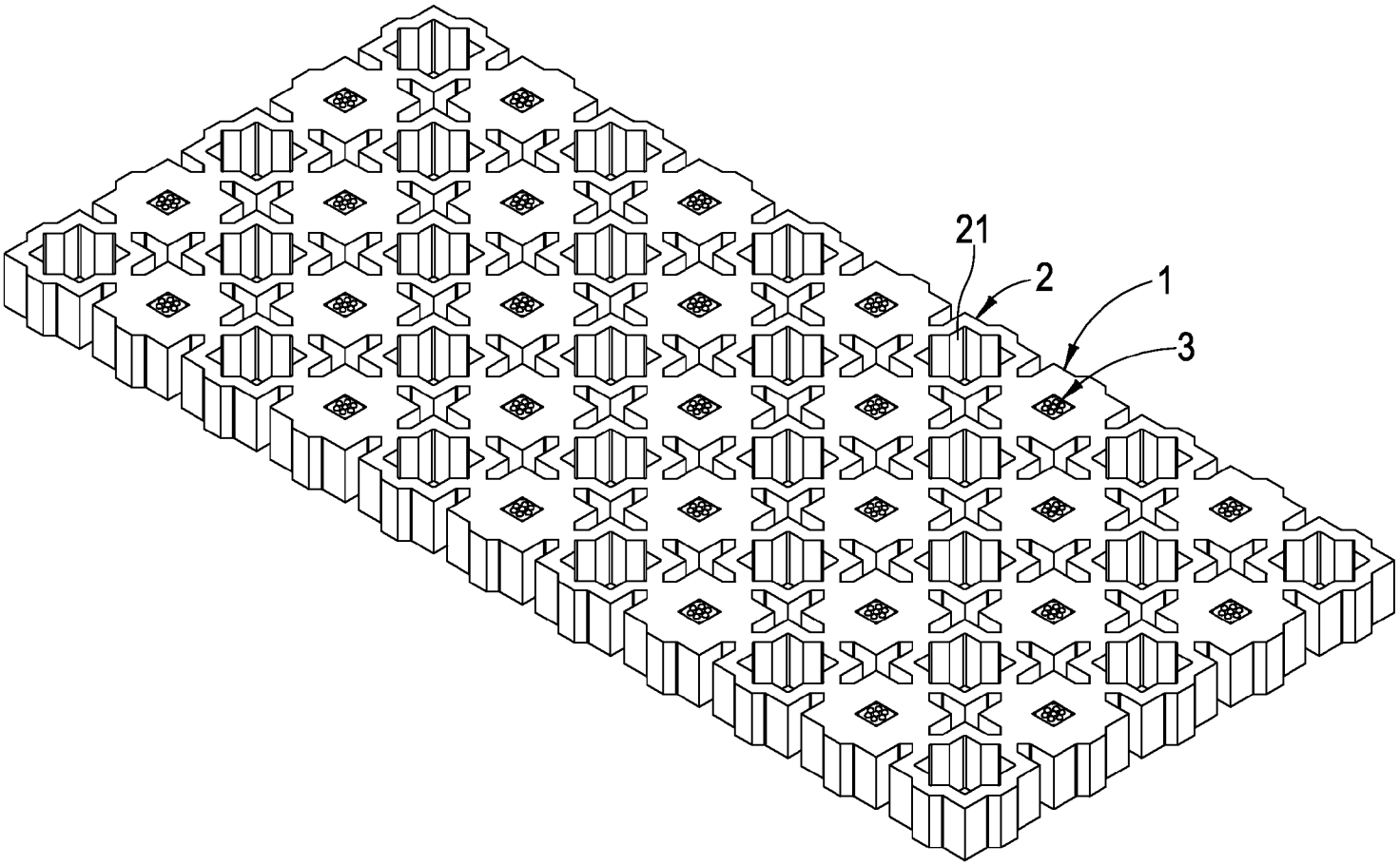
FIG. 5 is a perspective view showing another embodiment of the improved lamp structure of the present invention.

In addition, the improved lamp structure of the present invention comprising the carrier units 1 and the hollow heat dissipating units 2 may be integrally formed, as illustrated in FIG. 5; in this case, the goal of fast heat dissipation may still be reached.

Now, please refer to FIG. 3. After the carrier units 1 and the hollow heat dissipating units 2 are put together, the improved lamp structure of the present invention in the shape of a flat sheet is formed. Light emitting elements 3 may be fitted on the top surface or the bottom surface of each carrier unit 1 so that the light generated by the light emitting elements 3 may propagate upwards or downwards. Such structure may be used for a hanging lamp or other type of lamp.

Figure 4:
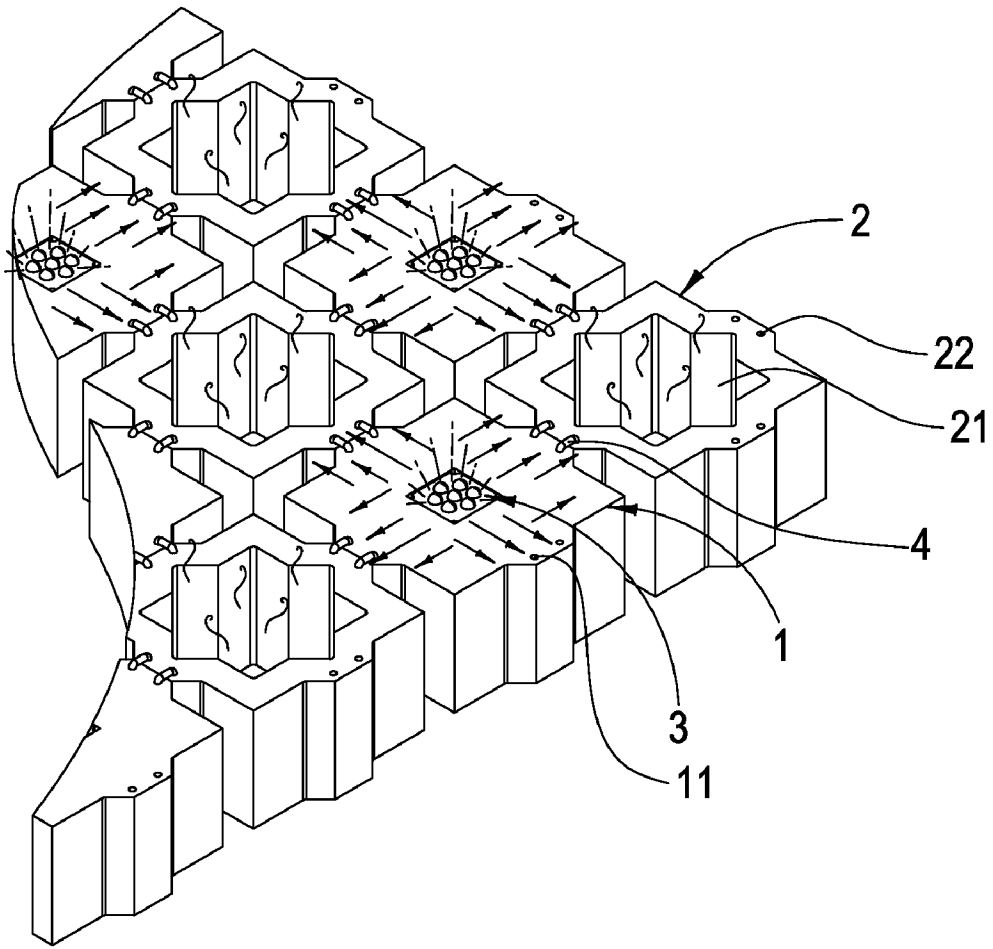
FIG. 4 is a perspective view showing how heat is dissipated swiftly.

FIG. 4 shows how heat is dissipated swiftly. When light is generated by the light emitting elements 3, heat is also generated. The heat is transferred to the carrier units 1 and then is swiftly passed onto the neighboring hollow heat dissipating units 2 and then is dissipated into the ambient air through the hollow portions 21. In this way, the goal of fast heat dissipation may be reached and hence the light emitting elements 3 may have a longer service life.

In comparison to other lamp structures of the prior art, the improved lamp structure of the present invention has the following two advantages:

1. The hollow heat dissipating units can swiftly dissipate the heat generated by the light emitting elements and hence the light emitting elements may have a longer service life.

2. The improved lamp structure of the present invention has a unique structure and is easy to assemble and use.

Although a preferred embodiment of the present invention has been described in detail hereinabove, it should be understood that the preferred embodiment is to be regarded in an illustrative manner rather than a restrictive manner, and all variations and modifications of the basic inventive concepts herein taught still fall within the scope of the present invention.

From the above, we can see that the improved lamp structure of the present invention meets the relevant patent requirements. It is hoped that the patent application will be approved.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lamp structure, comprising:

a plurality of heat dissipating carrier units, each of which having a flat top surface and a flat bottom surface so as to hold light emitting elements; and a plurality of hollow heat dissipating units, each of which having a flat top surface and a flat bottom surface and each of which having a centrally provided hollow portion, wherein the carrier units and the hollow heat dissipating units are put together in an alternating manner so that each carrier unit abuts on at least a hollow heat dissipating unit, and wherein two holes are provided on each of four sides of each carrier unit and two holes are provided on each of four sides of each hollow heat dissipating unit, and connective pieces are inserted into the holes so as to fixedly hold the carrier units and the hollow heat dissipating units together.

2. The lamp structure as in claim 1, wherein each of the connective pieces is made of two rivets.

3. The lamp structure as in claim 1, wherein the carrier units and the hollow heat dissipating units are integrally formed.

4. The lamp structure as in claim 1, wherein each carrier unit has a shape of a block and each hollow heat dissipating unit also has a shape of a block, a height of each heat dissipating unit being equal to that of each carrier unit.

* * * * *